US006296044B1

(12) United States Patent
Brooks et al.

(10) Patent No.: US 6,296,044 B1
(45) **Date of Patent: *Oct. 2, 2001**

(54) INJECTION MOLDING

(75) Inventors: James E. Brooks, Manvel; Wenbo Yang, Sugar Land, both of TX (US); Ronald G. Iacocca, State College, PA (US)

(73) Assignee: Schlumberger Technology Corporation, Sugar Land, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/103,884

(22) Filed: Jun. 24, 1998

(51) Int. Cl.[7] ..... B22D 23/06; B22D 18/02
(52) U.S. Cl. ..... 164/80; 164/120; 164/113
(58) Field of Search ..... 164/80, 120, 113

(56) References Cited

U.S. PATENT DOCUMENTS 5,913,256 * 6/1999 Lowden et al. ..... 75/248

FOREIGN PATENT DOCUMENTS 3-24205 * 2/1991 (JP) ..... 164/80
3-258452 * 11/1991 (JP) ..... 164/80

OTHER PUBLICATIONS

Randall M. German, Metal Injection Molding, Chicago, IL, Oct. 1997.*

* cited by examiner

*Primary Examiner*—Nam Nguyen
*Assistant Examiner*—I.-H. Lin
(74) *Attorney, Agent, or Firm*—Trop, Pruner & Hu P.C.

(57) ABSTRACT

In a method for injection molding of metallic mixtures, a metallic substance with a high melting point is mixed with a metallic substance having a lower melting point that serves in part as a binder material, and the mixture may be blended to form a homogenous feedstock for injection molding, or the mixture may be introduced directly into an injection molding apparatus.

22 Claims, 2 Drawing Sheets

INJECTION MOLDING

BACKGROUND

The invention relates to injection molding.

Injection molding is a technique in which objects may be formed by injecting a composition into a mold for the object. Injection molding can be used to form components for use in downhole applications in the oilfield industry, including components that contain metals. To form such metal-containing components using injection molding, a polymer is blended with a fine metal powder, and the mixture is processed by an injection molding apparatus. In some cases, a feedstock for an injection molding apparatus may be prepared by pelletizing a homogenous mixture of a powdered metal with a thermoplastic resin. Otherwise, an injection molding feedstock may be introduced directly into an injection molding apparatus. The non-metallic portion of the feedstock, generally an organic material such as a polymer, is referred to as the binder or the binder material.

After a part has been injection molded, it is usually conditioned to remove most of the binder material through a process called debinding. The binder can be removed with heat, a chemical solvent, or a combination of the two methods. While debinding typically does not cause a reduction in the size of a part formed by injection molding, debinding might generally cause a significant increase in the porosity of the part.

Injection molded parts are typically subjected to a sintering process where the part is heated to a temperature sufficient to cause the particles making up the part to fuse together. The sintering process usually causes the injection molded part to shrink, with a resulting increase in density and structural strength.

When powdered metallic mixtures are used for injection molding, the flow characteristics of the metal powder used may significantly impact the structural characteristics of the finished part once it has been debinded and sintered. One aspect of this relationship is that when the flow of the particles is hindered by interparticle friction during the metal injection molding process, it may result in an uneven distribution of particles in the finished part, thereby reducing the density and strength of the finished part.

SUMMARY

In general, in one aspect, the invention includes a feedstock for an injection molding apparatus including a first metallic mixture and a second metallic mixture, the first metallic mixture having a higher melting point than the second metallic mixture.

In general, in another aspect, the invention features a method for injection molding metallic mixtures, including selecting a first metallic mixture and a second metallic mixture, the first metallic mixture having a higher melting point than the second metallic mixture, and using an injection molding apparatus to combine a portion of the first and second metallic mixtures to form an object.

In general, in another aspect, the invention includes blending the above-mentioned first and second metallic mixtures to form a substantially homogenous feedstock for injection molding.

In general, in another aspect, the invention includes mixing an organic binder material into the first and second metallic mixtures, forming an object from the mixture through injection molding, and then removing the binder material from the injection molded object.

DETAILED DESCRIPTION

Figure 1:
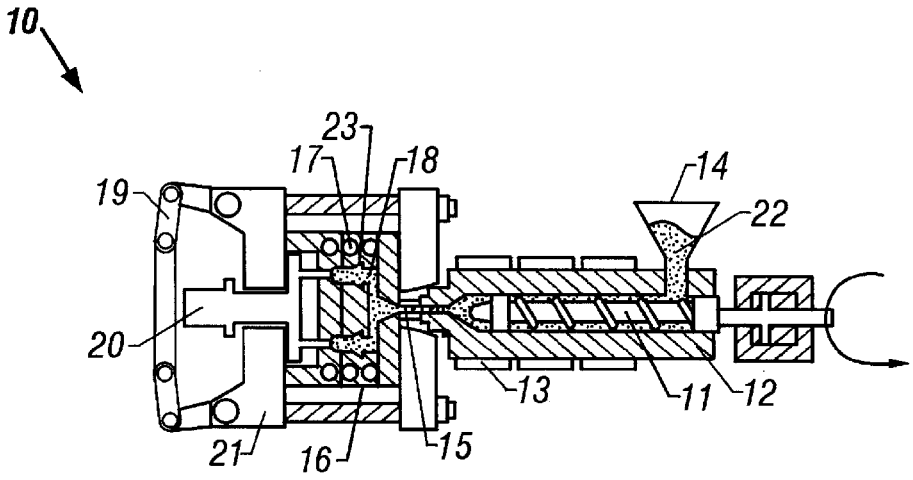
FIG. 1 is a schematic diagram of a compression-type injection molding apparatus.

Improvements to the flowability of metal particles in a metal injection molding process may yield structural advantages to the finished product. Likewise, improved flowability may also result in additional advantages, such as an expanded range of part configurations that may be produced, and a more even distribution of composition in the injection molded product, allowing for increases in the density and structural strength of parts made according to this method.

Flowability refers to the ability of the particles to move with respect to each other. The degree to which the distributions of composition, strength and density within a molded object are spread evenly throughout the object may be referred to collectively as structural characteristics of the object.

By use of a mixture of relatively high and low melting point metallic mixtures, the relatively low melting point portion of the mixture may serve in part as a binder material in an injection molding process. In this way, the density and structural strength of metal injection molded parts may be increased as the relatively low melting point portion of the injection molding mixture allows improved flowability of the mixture during an injection molding process.

A metallic mixture refers to any substance or mixture of substances that includes a metal, or that exhibits properties of a metal. For example, a metallic mixture can refer to an alloy, a mixture of metallic powders, or other mixtures of substances exhibiting metallic properties. The melting point of the mixture refers to the temperature at which substantially all of the components of the mixture are melted.

Under one possible embodiment of the present invention, two metal powders are selected for a metal injection molding process. The first powder has a melting point relatively higher than the second metal powder, and the second powder serves in part as a binder material during injection molding.

Metals that have relatively high melting points may include, as examples, tungsten, rhenium, tantalum, osmium, molybdenum, iridium, ruthenium, niobium, and hafnium. These exemplary metals all have melting points above 2000° C. Other metals with relatively high melting points may include nickel, iron, cobalt, copper, and uranium. Alloys of such high melting point metals may also be used. In addition, the powder with the relatively higher melting point may include non-metallic materials that are suitable for high temperatures, such as graphite.

Metals that have relatively low melting points may include, as examples, tellurium, zinc, lead, cadmium, thallium, bismuth, tin, and selenium. These exemplary metals all have melting points below 500° C. Alloys of such low melting point metals may also be used.

The foregoing lists of materials used for the metallic binder material and the main metallic material are not intended to be exhaustive. For example, other metallic materials having different melting points can be selected, such as metal alloys.

In the context of the present invention, injection molding refers generally to any process where a substance or mixture of substances is forced into a mold by pressure, or is melted and then poured or injected into a mold or cavity having a predetermined shape. Thus, an injection molding apparatus refers to any device that may be used to accomplish such a process.

Referring to FIG. 1, in an exemplary compression-type injection molding apparatus 10, a screw 11 is rotated within a cylinder 12 that is fitted with an external heater 13. An injection molding feedstock 22 containing a mixture of the metallic binder and main metallic material is introduced into the apparatus 10 through a feed hopper 14. The rotation of the screw 11 carries the feedstock 22 through the cylinder 12 where the metallic binder is heated to substantially liquid form by the external heater 13. The continuing action of the screw 11 builds up sufficient pressure to force the melted feedstock 22 through a nozzle 15. From the nozzle 15, the feedstock 22 moves into a molding cavity 18 of a die 16. The shape of the molding cavity 18 is preselected according to the shape that is desired for the molded object 23. Cooling channels 17 running generally transverse to the molding cavity 18 that carry water or other suitable liquid serve to solidify the feedstock molded object 23 in the molding cavity 18 by cooling the feedstock 22 to below its melting point. The molded object 23 is held in place in the molding cavity 18 is held over the nozzle 15 by a post 20. The post 20 is held in place by a clamp 19 that is attached to the frame 21 of the apparatus 10. When the molded object 23 is sufficiently cooled, the clamp 19 is released from the post 20, and the molded object 23 can be removed.

Figure 2:
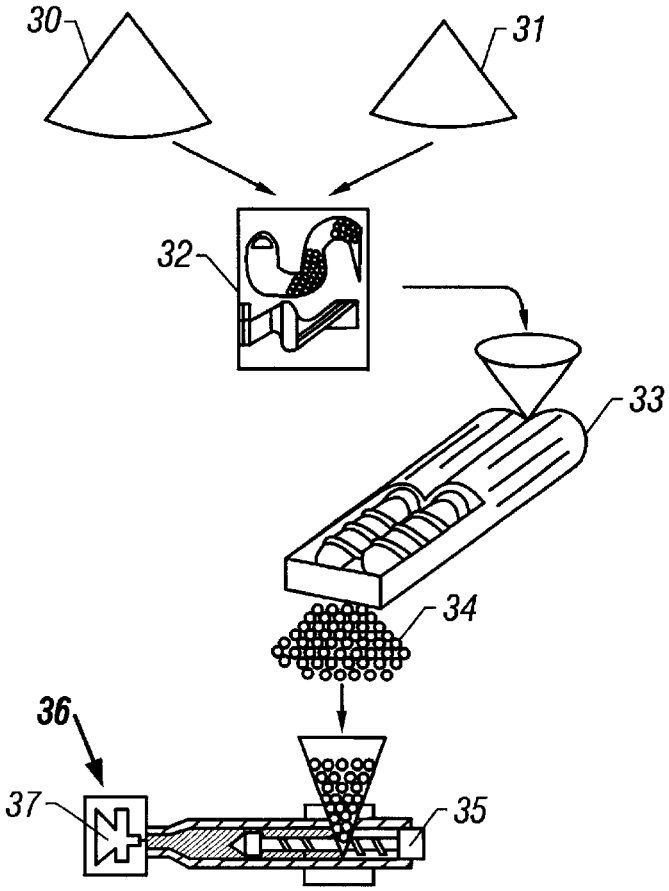
FIG. 2 is a schematic diagram of a process for injection molding metallic mixtures.

Referring to FIG. 2, to form the feedstock, a powder of a main metallic material 30 having a high melting point and a binder material 31 are premixed 32 to form a generally homogenous mixture. The binder 31 is a metal, alloy or metallic mixture having a lower melting point than the metal powder 30. In one embodiment, the premixing 32 may be conducted at an elevated temperature sufficient to melt the binder 31 to form a slurry of high temperature metal and melted binder (not shown).

After the premixing 32, the combined metal 30 and binder 31 are placed in a pelletizer 33 to form pellets 34. In this context, a mixture is substantially homogenous if each component of the mixture is substantially evenly distributed throughout the mixture. The pellets 34 are placed in an injection molding device 35 that substantially liquifies the binder portion 31 of the pellets 34 and forces the mixture into a mold 36. After the molded object 37 is allowed to cool, it is removed from the mold 36.

In another embodiment, a pelletizer 33 is not used, but instead the metal powder 30 and binder 31 are directly mixed into the injection molding device 35.

Figure 3:
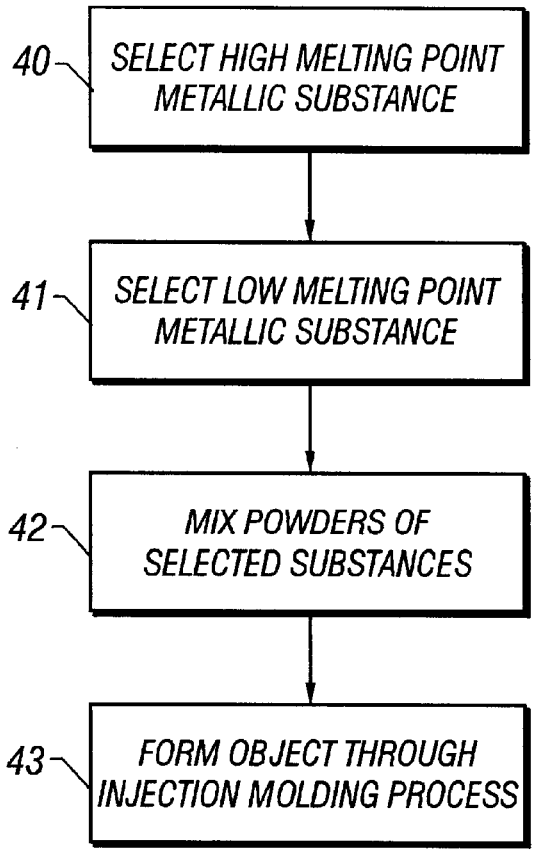
FIG. 3 is a flow diagram showing a method of injection molding metallic mixtures.

Referring to FIG. 3, a flow diagram presents a method of injection molding metallic mixtures according to an embodiment of the present invention. In a first step 40, a metallic substance having a high melting point is chosen to suit predetermined characteristics desired in a part that is to be made through injection molding.

The high melting point metallic substance may include, as examples, tungsten, tungsten alloys, tungsten ceramics, other compounds including tungsten, and metallic mixtures containing tungsten. Other metallic substances with high melting points might also be used. The predetermined characteristics may include, as examples, a characteristic that permits a molded part to be very durable and to be tolerant of very high temperatures.

At the next step 41, a second metallic substance is chosen that has a relatively low melting point in comparison with the metal chosen in step 40. A substance that might be chosen might include, for example, lead, compounds containing lead, and lead alloys. In the injection molding process, the low melting point metallic substance will serve in part as the binder material for the high melting point metallic substance. The low melting point metal may be chosen on the basis of various considerations, for example, its melting point, how it interacts with the high melting point metal, the desired physical characteristics of the finished part, and the specific application for the finished product.

At the next step 42, the metallic substances selected in steps 40 and 41 are initially in the form of fine powders and mixed together. For example, the average particle size of the metallic powders of steps 40 and 41 might be between about 10 and 40 micrometers in diameter.

The powders are then put into an injection molding apparatus in step 43, where they are molded by injection into a predetermined shape. For example, the predetermined shape can be a part. In one embodiment, before injection molding takes place, the powders are premixed to form a homogenous mixture, and they are then heated past the melting point of the metallic substance serving as the binding agent.

Figure 4:
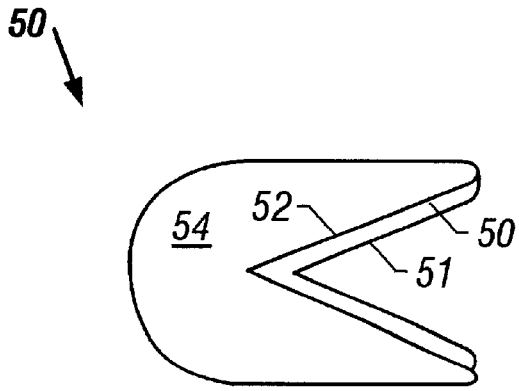
FIG. 4 is a schematic diagram of a shaped charge liner.

The molded part may take on one or more of many different forms. For example, the part may be a shaped charge liner 50 (See FIG. 4) in an oil well perforating gun. A shaped charge liner is used in a shaped charge, which may be used for creating perforations down-hole in a well. The shaped charge liner 50 may include a cone or other shape that has an inner surface 51 and an outer surface 52. An explosive 54 on the outer surface of the liner 50. When detonated, the explosive 54 causes the liner to collapse to form a perforating jet that can create a perforating tunnel in a down-hole rock formation. The shaped charge liner 50 can be constructed using injection molding from a dense, hard metal having a high melting temperature such as tungsten.

In another embodiment, the above-mentioned process may be used with a feedstock having a removable organic binder. Removable binders include binder materials that may be removed from an injection molded object either by heating the object or subjecting the object to a chemical solvent. As examples, removable binders include organic materials such as waxes, polymers, oils and resins. After such a binder material has been removed, the injection molded object may be subject to a sintering process to increase its density and structural strength.

Other embodiments are within the scope of the following claims. Although the present invention has been described with reference to specific exemplary embodiments, various modifications and variations may be made to these embodiments without departing from the spirit and scope of the invention as set forth in the claims.

What is claimed is:

1. A method for injection molding metallic mixtures, comprising:

mixing a first metallic material and a second metallic material to form a mixture, the first metallic material having a higher melting point than the second metallic material;

applying heat to the mixture to establish the temperature of the mixture above the melting point of the second metallic material and below the melting point of the first metallic material to form a slurry; and using injection molding to form a molded object from the slurry.

2. The method of claim 1, wherein components of the first metallic material are selected from the group consisting of tungsten, rhenium, tantalum, osmium, molybdenum, iridium, ruthenium, niobium, and hafnium.

3. The method of claim 1, wherein components of the second metallic material are selected from the group consisting of tellurium, zinc, lead, cadmium, thallium, bismuth, tin, and selenium.

4. The method of claim 1, wherein the first metallic material has a melting point of greater than about 2000° C.

5. The method of claim 1, wherein the second metallic material has a melting point lower than about 500° C.

6. The method of claim 1, wherein the molded object is a liner for a shaped charge.

7. The method of claim 1, further comprising blending the first and second metallic materials to form a substantially homogenous injection molding feedstock.

8. The method of claim 7, further comprising forming pellets containing the injection molding feedstock.

9. The method of claim 1, wherein the injection molding apparatus heats the first and second metallic materials to a temperature higher than the melting point of the second metallic material, but lower than the melting point of the first metallic material.

10. The method of claim 1, further comprising mixing a binder material into the first and second metallic materials prior to injection molding.

11. The method of claim 10, further comprising sintering the molded object to remove the binder material.

12. A method for manufacturing molding metal parts, comprising:

mixing a first metallic material and a metallic binder material, the first metallic material having a higher melting point than the binder material;

applying heat to establish the temperature of the mixture below the melting point of the first metallic material and above the melting point temperature of the binder material to form a slurry; and using injection molding to form a molded object from the slurry.

13. The method of claim 12, wherein substantially all of the components of the first metallic mixture are selected from the group consisting of tungsten, rhenium, tantalum, osmium, molybdenum, iridium, ruthenium, niobium, and hafnium.

14. The method of claim 12, wherein substantially all of the components of the second metallic mixture are selected from the group consisting of tellurium, zinc, lead, cadmium, thallium, bismuth, tin, and selenium.

15. The method of claim 12, wherein the first metallic mixture has a melting point of greater than about 2000° C.

16. The method of claim 12, wherein the second metallic mixture has a melting point lower than about 500° C.

17. The method of claim 12, wherein the molded object is a liner for a shaped charge.

18. The method of claim 12, further comprising blending the first metallic mixture and the second metallic mixture to form a substantially homogenous injection molding feedstock.

19. The method of claim 18, further comprising conditioning the injection molding feedstock to form pellets.

20. The method of claim 18, wherein the injection molding apparatus heats the first and second metallic mixtures to a temperature higher than the melting point of the second metallic mixture, but lower than the melting point of the first metallic mixture.

21. The method of claim 12, further comprising mixing a binder material into the first and second metallic mixtures.

22. The method of claim 21, further comprising sintering the molded object to remove the binder material.

* * * * *